US006062507A

United States Patent [19]

Summey, III

[11] Patent Number: 6,062,507

[45] Date of Patent: May 16, 2000

[54] VERTICAL WINDER AND METHOD

[75] Inventor: Shala W. Summey, III, Lyman, S.C.

[73] Assignee: Alexander Machinery, Inc., Simpsonville, S.C.

[21] Appl. No.: 09/240,728

[22] Filed: Jan. 29, 1999

[51] Int. Cl.[7] ..... B65H 18/10; B65H 18/16; B65H 18/26

[52] U.S. Cl. ..... 242/541; 242/541.6; 242/542.2

[58] Field of Search ..... 242/541.1, 541, 242/541.3, 541.4, 541.5, 541.6, 541.7, 542.4, 564.5, 542, 542.1, 542.2

[56] References Cited

U.S. PATENT DOCUMENTS

| | | | |
|---|---|---|---|
| 1,796,912 | 3/1931 | Wood | 242/564.5 |
| 3,822,836 | 7/1974 | Troyer et al. | 242/541.1 |
| 3,955,136 | 5/1976 | Wiltshire et al. | 242/541 |
| 4,139,166 | 2/1979 | Powell et al. | 242/542.1 |
| 4,489,900 | 12/1984 | Morizzo | 242/542 |
| 4,602,749 | 7/1986 | Vanhoutte | 424/541.4 |
| 4,858,843 | 8/1989 | Gierse et al. | 242/541 |
| 5,028,011 | 7/1991 | Schiffers | 242/541 |
| 5,791,583 | 8/1998 | Alexander et al. | 242/541.1 |
| 5,878,974 | 3/1999 | Schumacher et al. | 242/541 |

FOREIGN PATENT DOCUMENTS

| | | | |
|---|---|---|---|
| 1101938 | 3/1961 | Germany | 242/541 |
| 3438008 | 4/1986 | Germany | 242/541 |

*Primary Examiner*—John M. Jillions
*Attorney, Agent, or Firm*—Ralph Bailey, P.A.

[57] ABSTRACT

A vertical winder for winding a web on a center wound roll has a fixed vertical frame (A) supporting a carriage for vertical movement thereon. The carriage has a vertically movable upright section (B) and a cantilevered section (C) positioning at least one elongated driven roll (D) above the center wound roll. A drive motor (E) mounted on the carriage drives the elongated drive roll, and a fluid-operated cylinder (F) positions the elongated carriage between lowered and raised positions during the build of a center wound roll. The method provides for delivering a web in open width at a central location to the center wound roll during driving and building of the center wound roll.

12 Claims, 6 Drawing Sheets

W
17
E
18
22
C
25
26
16
D
30
A
14
35
12
B
13
25
F
10
11
23

VERTICAL WINDER AND METHOD

BACKGROUND OF THE INVENTION

This invention relates to a vertical winder for a web such as textile material providing consistent contact pressure from a drive roll to produce a uniform center wound roll.

The prior art is illustrated in U.S. Pat. No. 4,139,166 which incorporates a pivoted arm for carrying drive rolls for applying fabric to a center wound roll that is typically carried by an A-frame and the like. A major problem with the winder of U.S. Pat. No. 4,139,166 stems from an inherent problem in utilizing a pivoted arm. The angle of incidence between the drive roll or rolls and the fabric of the center wound roll driven thereby varies during the build because of the range of positions assumed by the pivoted arm as the size of the center wound roll increases. While the apparatus of the prior art is simple the problems engendered by the pivoted arm made it difficult to maintain even contact pressure of the drive roll or rolls with the center wound roll so that varying tensions on the web result in variations in roll harness during the build of the center wound roll. These problems multiply during further processing sometimes resulting in damage to the cloth.

The prior art is further illustrated by U.S. Pat. Nos. 4,602,749, 4,781,335, 5,518,199, and 5,791,583. U.S. Pat. No. 4,602,749, for example, illustrates an A-frame construction wherein a drive roll assembly is counter weighted above a central axis of a center wound roll. U.S. Pat. No. 4,781,335 shows an offset driven rubber covered pulley for driving a flange of a beam for winding cable. U.S. Pat. No. 5,518,199 discloses multiple positioning for winding paper strips cut from a wide paper web upon a center wound roll. Pat. U.S. No. 5,791,583 shows a loom cloth take up including a pivoted arm with apparatus for controlling tension in the cloth during the build of the roll.

Apparatus constructed in accordance with the present invention provides compact winding of fabric as, for example, on a batcher, with consistent contact pressure from the drive roll. While the invention is described in connection with the winding of textile fabric, there are many other uses for the method and for winders constructed in accordance with the present invention as, for example, in the paper industry.

SUMMARY OF THE INVENTION

Accordingly, it is an important object of the invention to provide a winder, batcher and the like with controlled contact pressure between a drive roll and a center wound roll during the build as well as structural integrity for heavy duty applications.

Another important object of the invention is to provide a center drive pedestal or fixed frame that allows the web to be wound utilizing center drive, surface drive, or center-surface drive combinations. These alternatives permit a uniform center wound roll for most fabrics.

Another important object of the invention is to provide for proper startup of a roll with uniform build of the fabric convolutions on a suitable mandrel for center winding of textile fabrics.

Another important object of the invention is to provide a drive roll assembly including spaced parallel drive rolls affording a packing ratio by driving the respective rolls at slightly different speeds. The drive rolls may be coupled, for example, with a mechanical device such as a chain or they may be driven as by a separate motor in driving relation to each roll.

Another important object of the invention is to provide apparatus for maintaining a carriage and drive roll carried thereby level during the build of the center wound roll.

The method and apparatus in accordance of the invention contemplates providing a carriage for positioning a drive roll assembly including one or more drive rolls carried thereby in cantilevered relation to a vertical frame, above a central location with respect to the center wound roll during the entire build of the roll. The drive roll or rolls are raised during the winding in a vertical path for delivering web material to the center wound roll during the winding under controlled tension.

Thus, the vertical frame provides a pedestal that allows the web to wind with any combination of center drive, surface drive, or both center-surface combination. Even contact pressure from start-up to finish of roll is an important advantage of the vertical winder.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a vertical winder for winding a web W in open width on a center wound roll. The winder includes a stationary vertical frame A and an elongated carriage mounted for vertical movement on the vertical frame. The elongated carriage has an upright section B guided for vertical movement on the vertical frame, and a cantilevered section C carried by the vertical section in superposed relation to a center wound roll being wound on the vertical winder. At least one elongated drive roll D on the cantilevered section is in alignment with the center wound roll. A drive motor E is mounted on the carriage for driving the elongated drive roll, and a fluid-operated apparatus F is illustrated for positioning the elongated carriage on the vertical frame during winding. The method contemplates raising the drive roll D during winding in a vertical path delivering web material at a central location at all times while supporting the drive roll on each end at a predetermined level.

Figure 1:
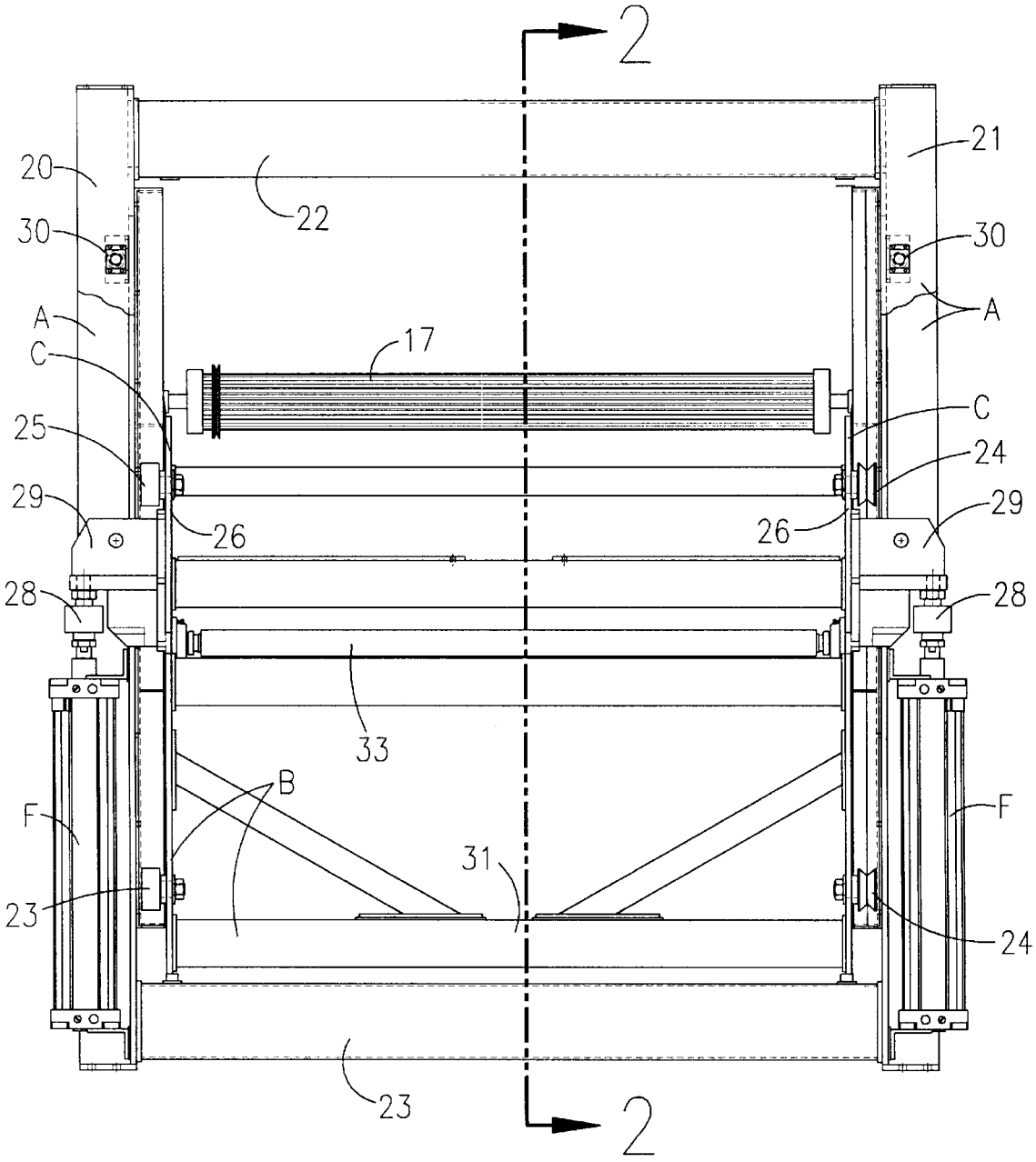
FIG. 1 is a front elevation illustrating a vertical winder constructed in accordance with the invention with parts broken away and parts omitted.
Figure 2:
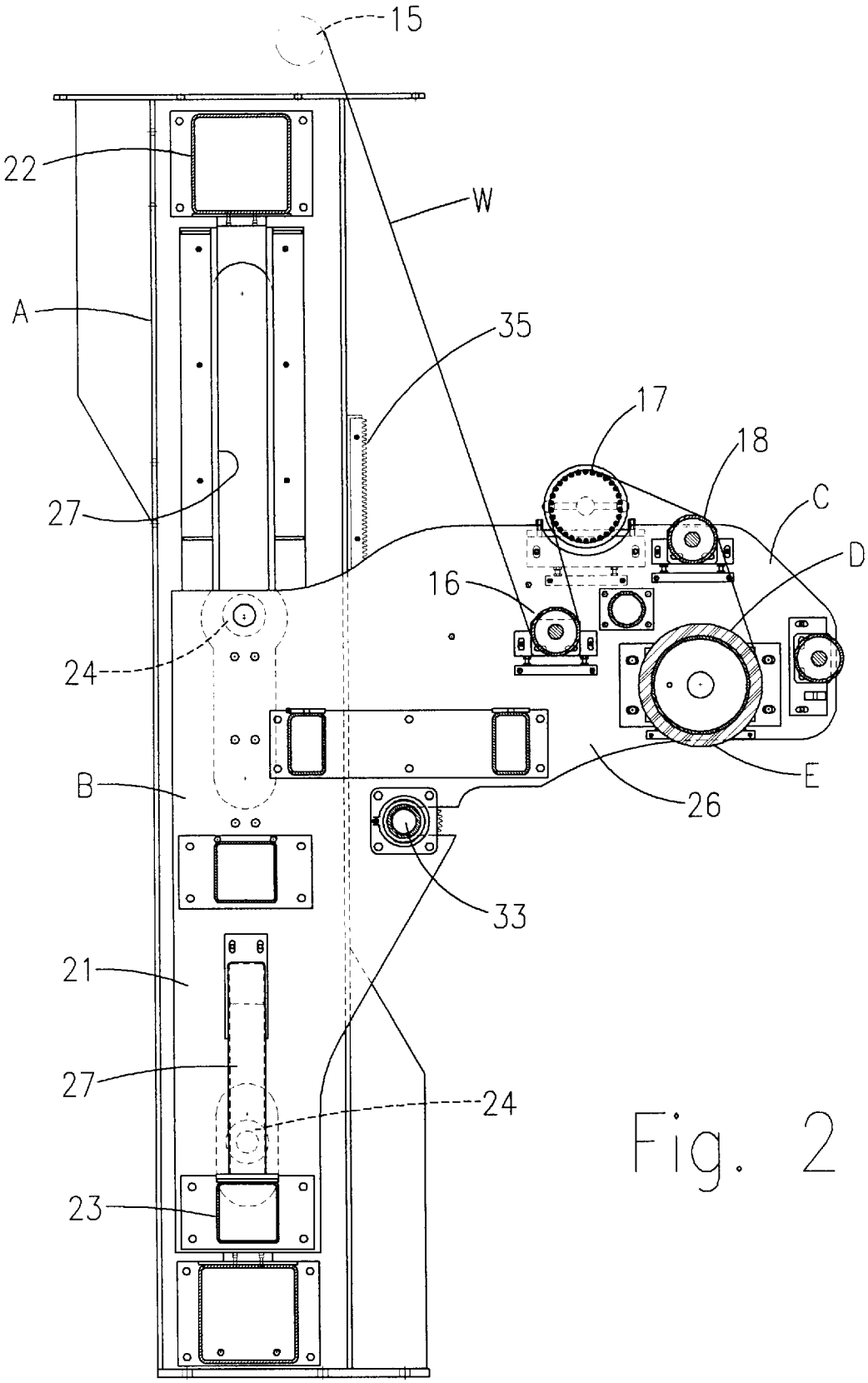
FIG. 2 is a transverse sectional elevation taken on the line 2—2 in FIG. 1 at an enlarged scale.
Figure 3:
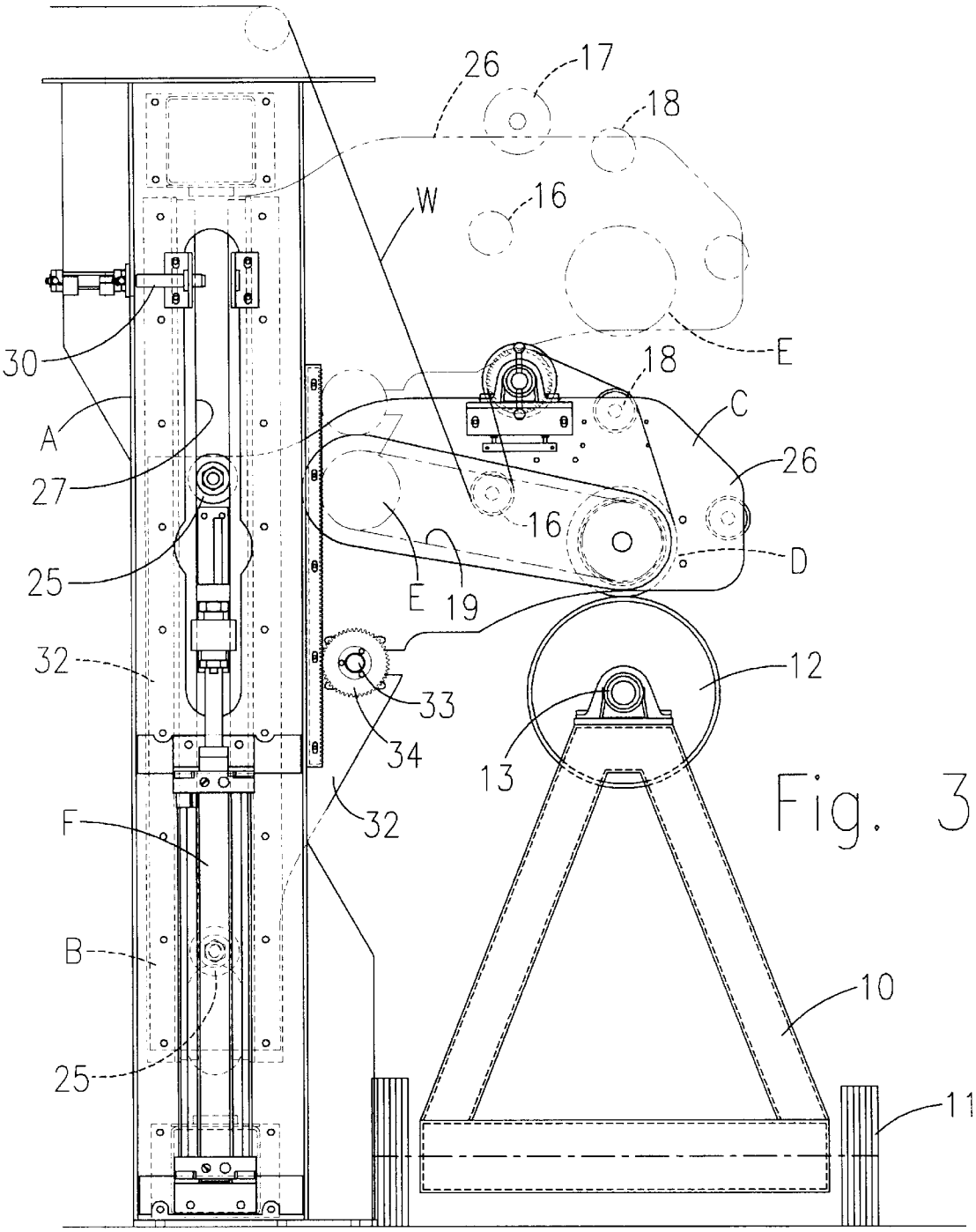
FIG. 3 is a side elevation looking toward the left side of FIG. 1 illustrating a vertically movable carriage carrying a drive roll in lowered solid line position at the beginning of the build of a center wound roll on an A-frame positioned in off-set relation to a vertical frame or pedestal.
Figure 4:
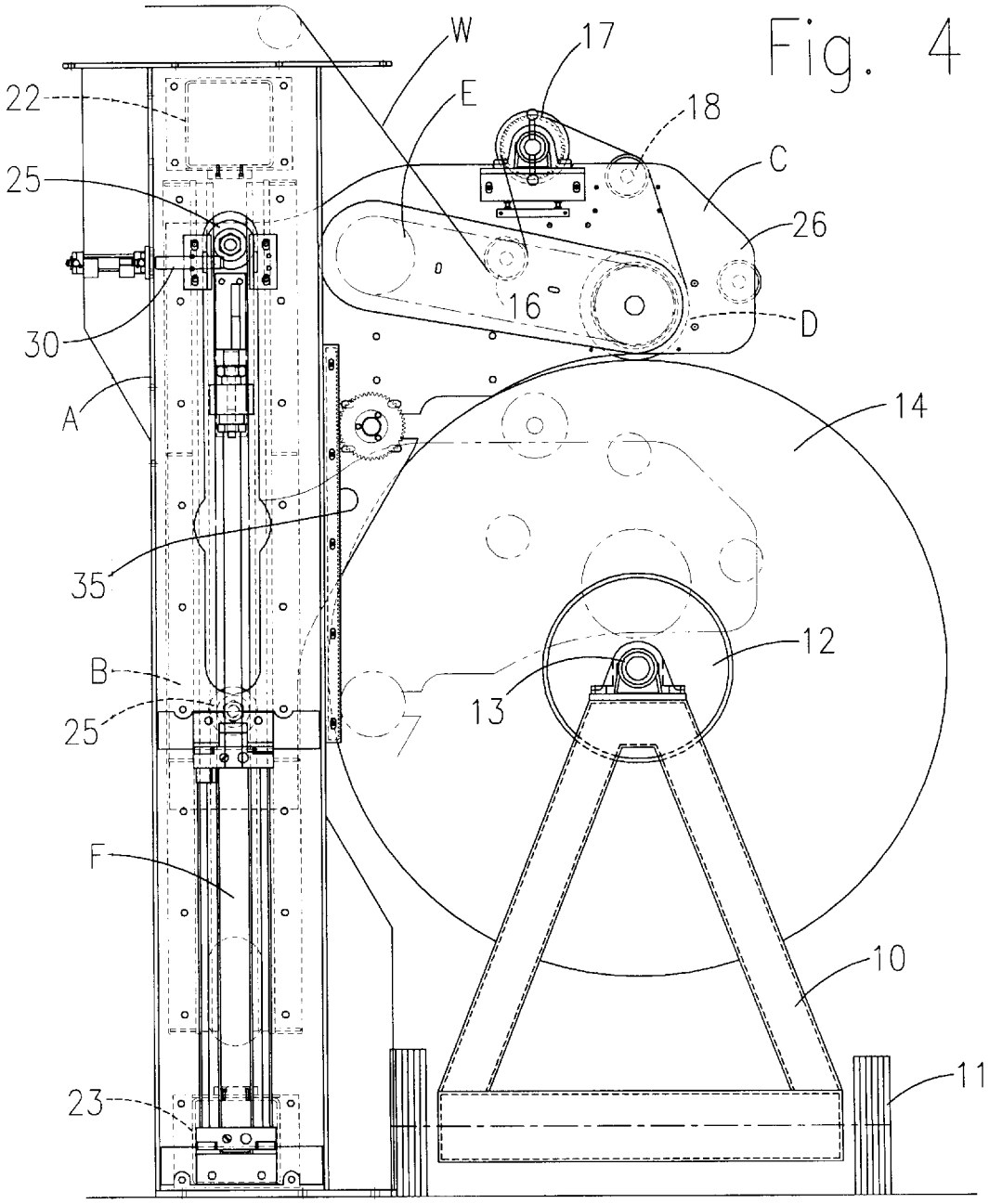
FIG. 4 is a side elevation similar to FIG. 3 illustrating the carriage in a raised solid line position at the finish of the build of the roll.

FIGS. 1–4 best illustrate the vertical frame A supporting a drive roll above a center wound roll carried in side by side relation to the vertical frame. An A-frame broadly designated at 10 is illustrated in FIGS. 3 and 4. The A-frame 10 includes suitable wheels 11. A mandrel 12 is mounted for rotation in bearings 13 atop the A-frame. Thus, a completed center wound roll illustrated as at 14 in FIG. 4 may be readily removed upon completion of the wind. A start up of the build is illustrated in FIG. 3 wherein a web W is delivered from a suitable supply over a roll 15 to an idler roll 16 carried by the cantilevered portion C of the carriage and over a driven spreader roll 17, across an idler roll 18 and thence to the driven roll D. The driven roll D acts as a nip roll and may be best described as a friction roll. The friction roll may be provided with a coating to achieve a suitable coefficient of friction.

The web W is delivered in FIG. 3 over the driven roll D and thence to the mandrel 12 or some other suitable core for building the roll 14. It will be observed that the driven roll D is driven by the motor E through suitable belts schematically illustrated as at 19. The roll assembly of FIGS. 1–4 is illustrated as including a single drive roll D.

It is significant that the frame or pedestal A includes a pair of spaced vertical standards 20 and 21 between which are positioned upper and lower horizontal frame members 22 and 23, respectively. The vertical frame A carries the upright carriage section B which is guided for vertical movement by V-rolls 24 on one side of the frame and flat surfaced rolls 25 on the other side of the frame to provide stability avoiding sway during the guided vertical traverse of the carriage. The cantilevered section includes an outwardly extending frame portion 26 on each side of the frame B for supporting the drive roll D, spreader roll 17, drive motor E and axillary rolls for controlling the delivery of the web W to the mandrel 12. It will be observed in FIGS. 2–4 that the driven roll is carried vertically and centrally above the mandrel and the fabric delivered thereto during the build of the center wound roll. The guide rolls 24 and 25 are carried within opposed vertical trackways 27 within the vertical frame members 20 and 21.

A suitable fluid-operated cylinder F which may be pneumatic is provided with a suitable coupling 28 at each side to a mounting 29 carried by the upright section B for supporting the upright section responsive to suitable controls such as described below for governing the force exerted by the drive roll E upon the cloth and the center wound roll during the build. In order to secure the carriage including the upright section B and cantilevered section C in a raised position a power-operated latch including a latching plunger 30 is provided for engagement with the upright frame A. It will be observed that the upright section B is supported by a horizontal bridging frame member 31 extending between the end frame members 32 from which the cantilevered frame members 26 extend integrally and outwardly therefrom. The frame members 32 carry a counter shaft 33 which carries a pinion 34 at each end for engaging a rack 35 carried on each side of the frame A for maintaining the carriage in predetermined level positions at all times during the build.

The rigid carriage construction prevents the assembly from moving or swaying during acceleration or deceleration of the web. Thus, an affect on contact pressure with fabric web is avoided.

An electronic regulator current to pressure or voltage to pressure may be used to vary the contact pressure during operation. This is especially effective during the winding of delicate fabrics, laminates, and the like. A linear potentiometer, transducer, or other feedback means may also be used in controlling contact pressure.

The winder may also be used for non-contact operation with the winding web. Here the drive roll may operate, for example, approximately one-inch above the wound web material in the roll. A motor may be attached directly to the mandrel for winding the web. This allows the web roll to be center driven with no contact from the surface drive roll. Alternatively, a combination of center drive and surface drive winding, where the surface drive roll is in contact with the wound web and the mandrel is also directly motor driven, may be utilized. The roll may be surface driven with the direct motor drive disabled is a third alternative. From the above drive combinations, most webs may be wound with minimal problems as associated with just center winding or surface-winding.

Figure 5:
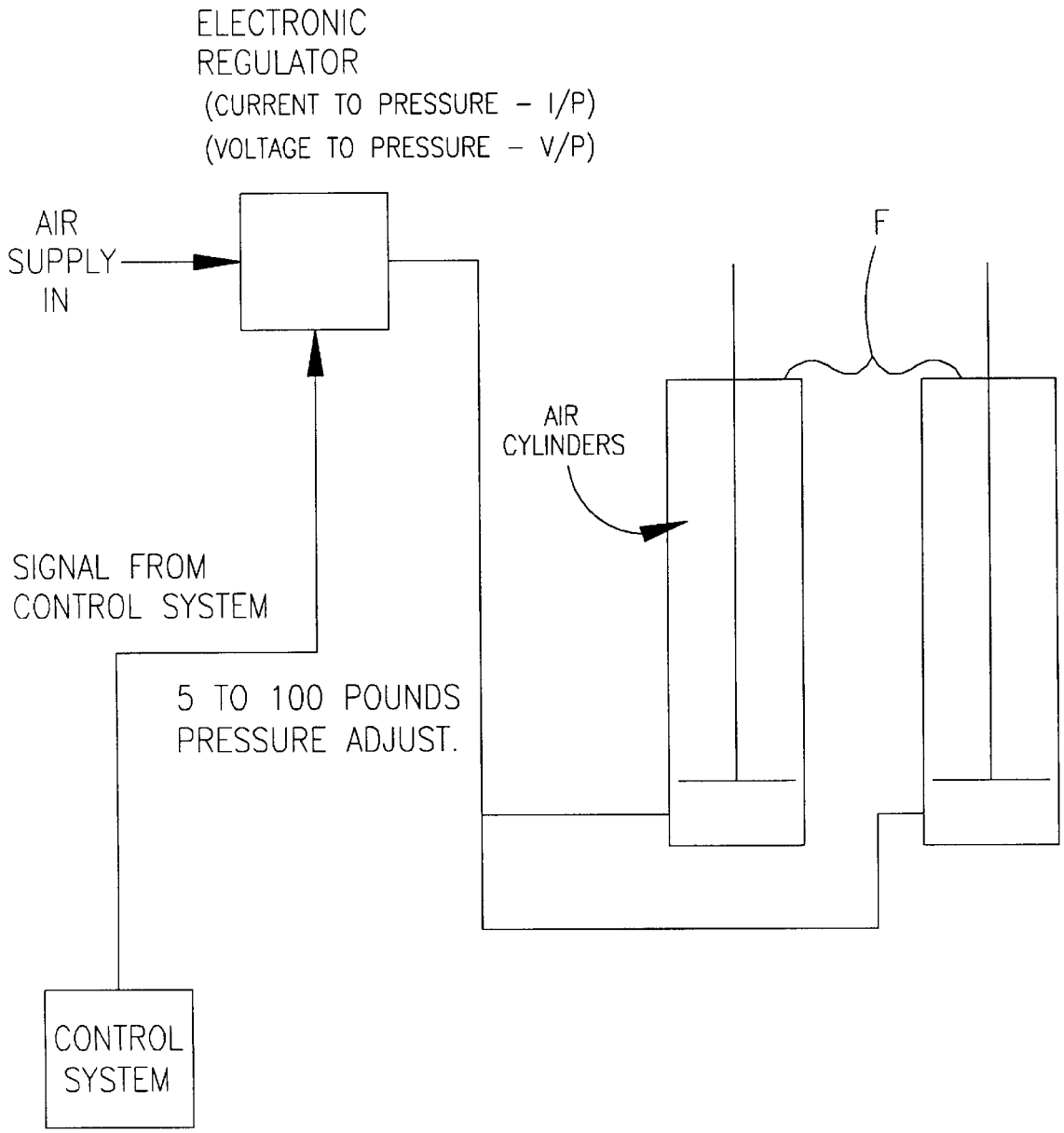
FIG. 5 is a block diagram illustrating pneumatic cylinders and controls for positioning the carriage regulating the pressure exerted by the driven roll upon the fabric and upon the center wound roll.

FIG. 5 illustrates the use of an electronic regulator for receiving a voltage or current signal from the control system, or controlling device. This signal may take the form of a raise signal, run signal, balance signal, and a lower signal. The regulator is preferably infinity variable.

Variable Packing Ratio

Figure 6:
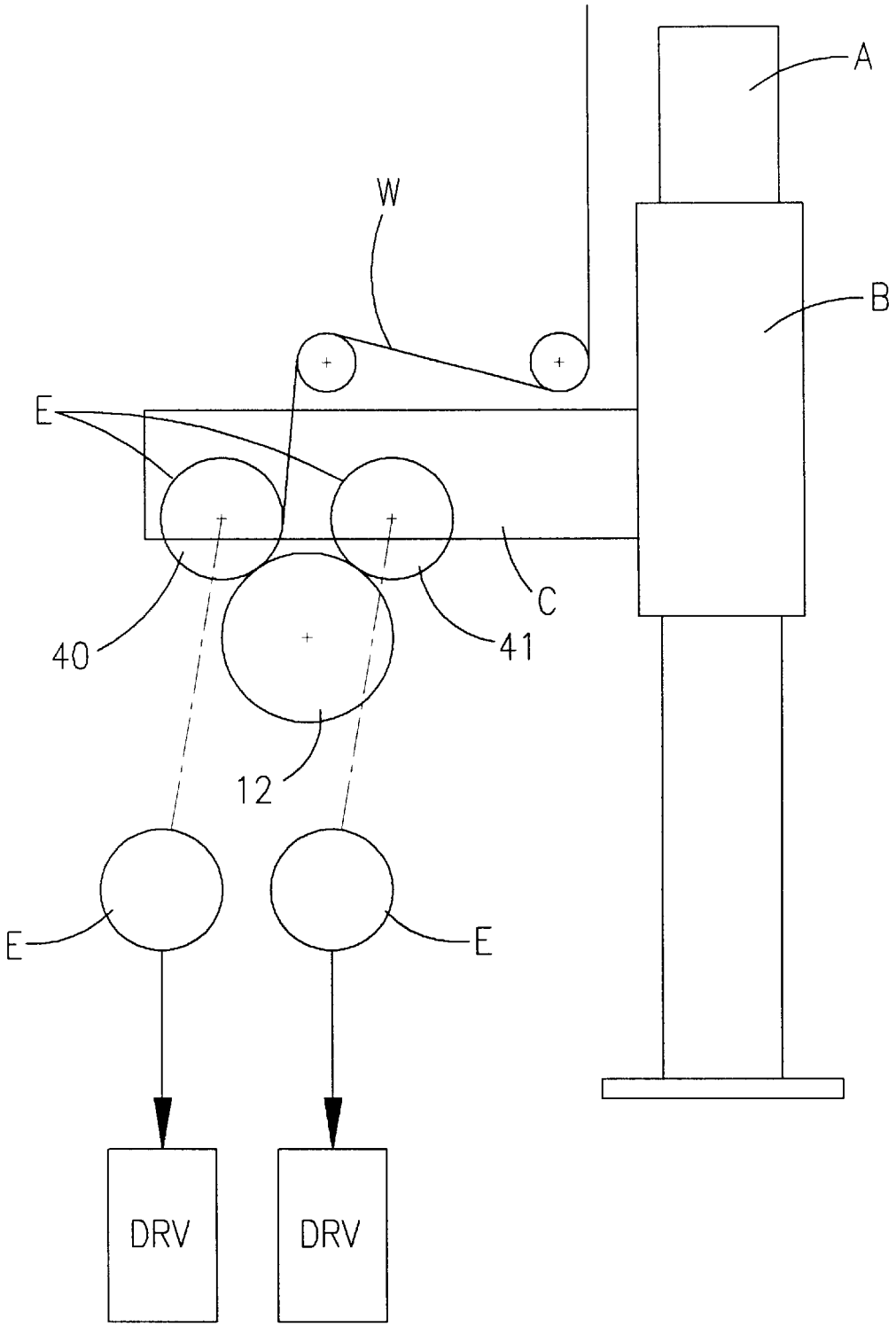
FIG. 6 is a schematic side elevation looking toward the right side in FIG. 1 illustrating a modified form of the invention with a separate drive for each of a pair of drive rolls for providing a packing ratio.

Both drive rolls 40 and 41 may be powered by separate motors as illustrated in FIG. 6 to form an alternate drive roll assembly E. Each motor is independently adjustable to create a speed difference for varying package density. A package can be wound in both clockwise and counterclockwise directions. The speed of the wind is governed by process line speed.

While a preferred embodiment of the invention has been described using specific terms, such description is for illustrative purposes only, and it is to be understood that changes and variations may be made without departing from the spirit or scope of the following claims.

What is claimed is:

1. A vertical winder for winding a web in open width onto a center wound roll comprising:

a stationary vertical frame;

an elongated carriage mounted for vertical movement on the vertical frame;

the elongated carriage having an upright section guided for vertical movement on the vertical frame, and a cantilevered section carried by the upright section in superposed relation to the center wound roll;

at least one elongated drive roll on the cantilevered section in alignment for engagement with the center wound roll;

a drive including a motor carried by the elongated carriage for rotating the elongated drive roll; and a power-operated apparatus for moving the elongated carriage vertically on the vertical frame during winding.

2. The vertical winder set forth in claim 1 including a shaft extending across the carriage; and interengaging apparatus at each end of the shaft and at each side of the vertical frame positioning the carriage at a predetermined level.

3. The vertical winder set forth in claim 1 including a vertical trackway on each end of the vertical frame; and a pair of vertically spaced guide rolls carried by each side of the carriage engaging respective trackways.

4. The vertical winder set forth in claim 3 including guide rolls having a V-shaped periphery on one side of the vertical frame, and guide rolls having a flat periphery on the other side of the vertical frame.

5. The vertical winder set forth in claim 1 including a pair of drive rolls on the cantilevered section spaced on respective sides of a center of the center wound roll; and a drive for rotating the respective rolls at varying speeds for creating a packing ratio therebetween.

6. The vertical winder set forth in claim 1 wherein the power-operated apparatus includes a fluid-operated cylinder at each side of the vertical frame, and a regulator for controlling the fluid-operated cylinder to maintain predetermined levels of the carriage.

7. The vertical winder set forth in claim 1 wherein the drive includes a motor carried on the cantilevered section of the carriage.

8. The method of winding a center wound roll of web material comprising the steps of:

mounting a cantilevered section for vertical movement on a stationary vertical frame;

moving the center wound roll to a position beneath the cantilevered section for rotation during winding of the center wound roll;

supporting a drive roll assembly on the cantilevered section above a central location in respect to the center wound roll during winding of the center wound roll;

raising the cantilevered section and the drive roll assembly carried thereon in a vertical path delivering web material to the center wound roll during winding; and supporting the drive roll assembly on each end at a predetermined level during winding for controlling delivery of the web to the center wound roll.

9. The method of winding set forth in claim 8 including the step of: positioning the center wound roll on an A-frame during winding in side by side relation to a vertical frame carrying the drive roll assembly for vertical movement.

10. The method of winding set forth in claim 9 including the steps of: positioning the drive roll assembly out of contact with the web roll during winding but in engagement with the web for delivering the web to the web roll, and directly driving a mandrel carrying the web roll on the A-frame.

11. The method set forth in claim 9 including the step of: driving the web roll entirely by frictional engagement with the drive roll.

12. The method set forth in claim 9 including the step of driving the web roll in part by frictional engagement with the drive roll and in part by directly driving a mandrel carrying the web roll.

* * * * *